United States Patent [19]

Lusk

[11] Patent Number: 4,648,321

[45] Date of Patent: Mar. 10, 1987

[54] MISSILE SEPARATION SYSTEM

[75] Inventor: Kenneth P. Lusk, Ridgecrest, Calif.

[73] Assignee: The United States of America as represented by the Secretary of the Navy, Washington, D.C.

[21] Appl. No.: 720,204

[22] Filed: Apr. 4, 1985

[51] Int. Cl.[4] ..... F42B 13/32; F42B 15/02

[52] U.S. Cl. ..... 102/293; 102/378; 102/388

[58] Field of Search ..... 102/293, 377, 378, 388

[56] References Cited

U.S. PATENT DOCUMENTS

| | | | |
|---|---|---|---|
| 2,871,750 | 2/1959 | Parrish | 102/293 |
| 2,968,245 | 1/1961 | Sutton et al. | 102/377 |
| 3,237,521 | 3/1966 | Francis | 102/293 |
| 4,485,740 | 12/1984 | Boss | 102/293 |
| 4,516,499 | 5/1985 | Eyman | 102/293 |

*Primary Examiner*—Charles T. Jordan

*Attorney, Agent, or Firm*—W. Thom Skeer

[57] ABSTRACT

A missile separation system for fixedly attaching a rocket motor section and a payload section has cofunctioning attaching and retarding means integrated to retain plural sections of a missile system in mated relationship until a predetermined point in the missile flight path.

8 Claims, 3 Drawing Figures

MISSILE SEPARATION SYSTEM

BACKGROUND OF THE INVENTION

1. Field of the Invention

This invention relates to separation assemblies and more particularly to a missile section separation assembly.

2. Description of the Prior Art

Missiles are conventionally made from a plurality of sections which are designed so as to be separable during the missile flight at a predetermined point in the flight path. For example the booster or motor section of the missile is usually separated from the remaining portion of the missile during the flight after the propellant in the booster section has been expended.

The separation assembly of this invention has utility in numerous separable combinations although it is primarily intended for use in target or research missiles. This type of missile is presently being utilized for high altitude targets or the collect high altitude atmospheric data. They are commonly made from two parts which include a rocket motor section and a payload section. Near the apex of the missile's trajectory, the payload section and the rocket motor section are separated and a parachute is deployed. The parachute functions to support the missile as it falls slowly through the target area or while it collects atmospheric data and relays that information electronically to the ground.

SUMMARY OF THE INVENTION

The missile separation system of this invention includes a rocket motor section interconnected to a payload section which houses electronic equipment and the like, by a separation or canister section. The canister section is detachably attached to the payload section utilizing peripheral recesses associated therewith in conjunction with explosive bolts in communication with these recesses for rigidly mating the canister section with the payload section. The canister section is also provided with an air brake system or retarding means for insuring the separation of the missile elements.

With the foregoing in mind it is a principal objective of this invention to provide a relatively uncomplicated and inexpensive separation system for positively and efficiently separating plural sections of a component system such as a missile system.

More particularly, an object of this invention is a missile canister section for joining together a rocket motor section and a payload section which canister section insures a clean separation of the missile components along a predetermined separation interface.

Yet another object of the invention is the incorporation of a retarding structure within a missile separation assembly to enhance the separation of the canister section from the payload section.

These and other objects of the invention will become more readily apparent from the following specification when read in light of the drawings.

BRIEF DESCRIPTION OF THE DRAWINGS

The present invention is illustrated in the accompanying drawings of which.

DESCRIPTION OF THE PREFERRED EMBODIMENT

Figure 1:
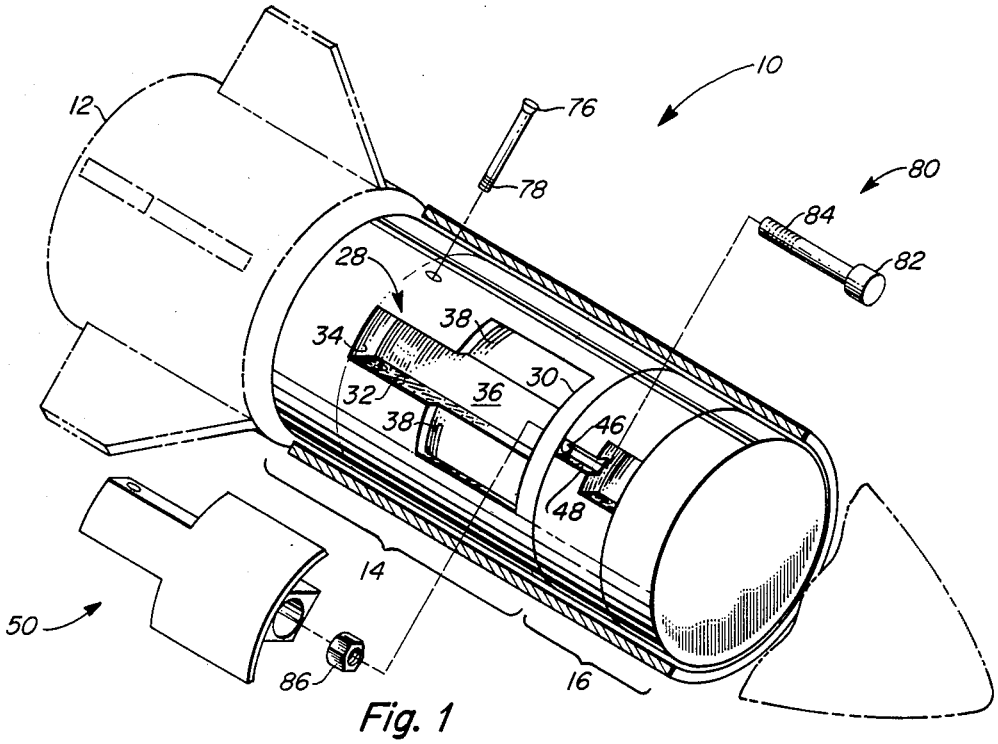
FIG. 1 is a sectional view of a missile embodying the invention.

Referring to the drawings wherein like reference characters designate corresponding parts throughout the several figures, a missile indicated generally by the reference character 10, of conventional configuration is formed of three principle sections. A rocket motor section 12 interconnected to a separation or canister section 14 and a payload section 16 which houses electronic equipment such as measuring and transmitting equipment, programming devices and the like. Canister section 14 and rocket motor section 12 are joined together by conventional means forming no part of the present invention.

Figure 3:
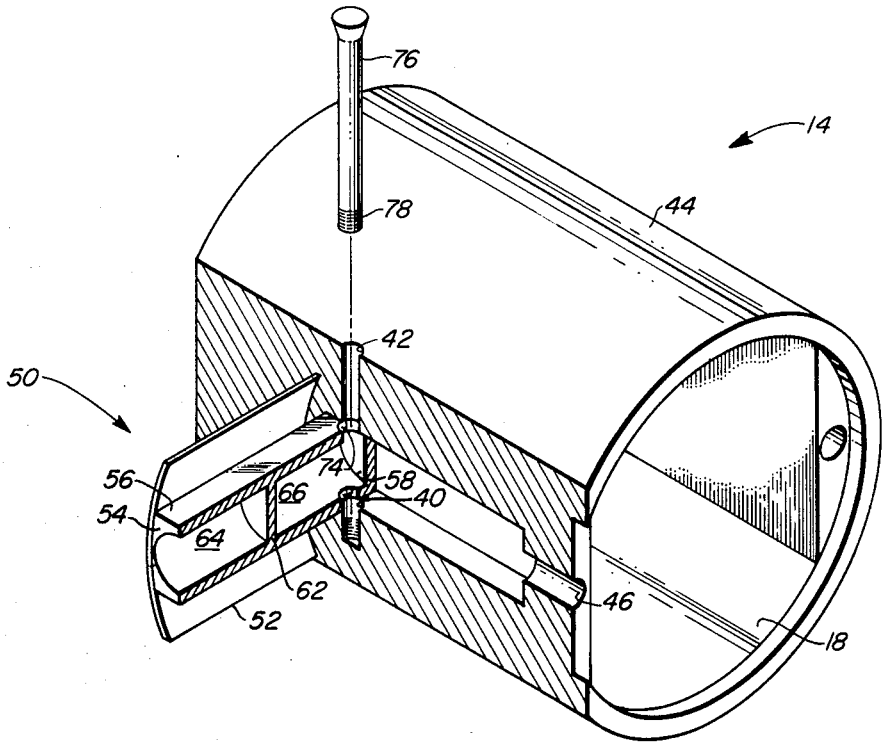
FIG. 3 is a perspective view taken along line 3—3 of FIG. 2.
Figure 2:
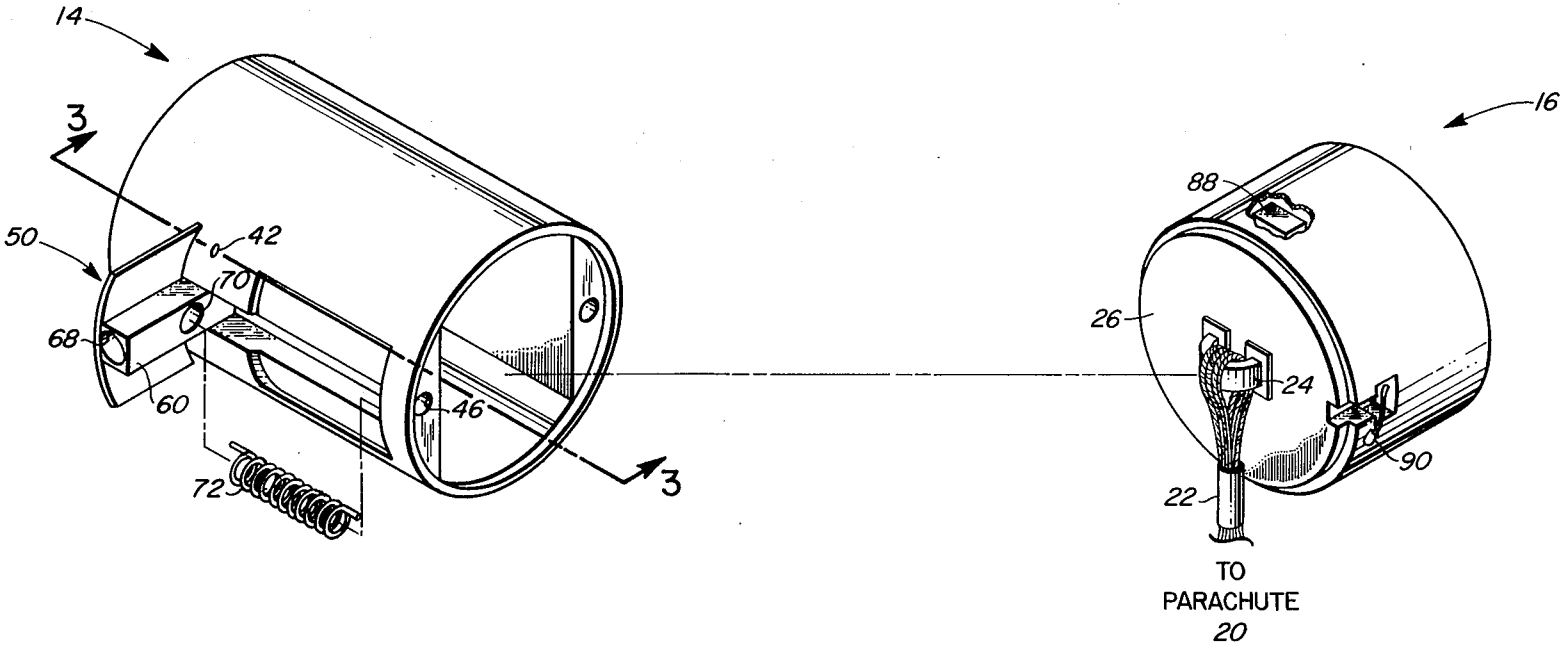
FIG. 2 is an exploded view of the missile separation system.

With reference to FIGS. 2 and 3, canister section 14 defines a central cavity 18 open on one end for receiving and housing a deployable parachute 20 which is provided with cord 22 for attachment to a U-bolt 24 in payload section 16. When canister section 14 and payload section 16 are joined together as more clearly described below, the base 26 of the payload section forms a cover over cavity 18 for retention of the parachute until sectional separation.

As shown in FIGS. 1 and 3, a pair of longitudinally aligned primary peripheral recesses 28 defining front, side and rear walls 30, 32, 34, and bottom 36 are located on opposing sides of canister section 14. On opposing sides of these primary recesses 28 are located secondary recesses 38 in parallel alignment along the longitudinal axis and in communication with the primary recesses. Proximate the rear walls 34 of each primary recess 28 as best shown in FIG. 3 is a threaded bore 40 and an opposing smooth bore 42 aligned with the threaded bore. This smooth bore 42 communicates with the exterior surface 44 of the canister section 14. The front wall 30 of each primary recess 28 is provided with a connecting bore 46. When the canister section 14 and payload section 16 are joined, these bores 46 form a passageway between each primary recess 28 in the canister section and peripheral channels 48 within each payload section.

As depicted in FIGS. 2 and 3, within each canister section primary recess 28 are axially aligned braking or retarding means indicated generally by numeral 50. These retarding means define rectangular shaped retarding structures 50 having arcuate shaped surfaces 52, front, side and rear walls 54, 56, 58, and bottoms 60. Each structure 50 includes a bulkhead wall 62 vertically disposed between front and rear walls 54 and 58 defining front and rear chamber 64 and 66. Each front wall 54 and bottom 60 have circular openings 68 and 70 communicating with the front 64 and rear 66 chambers respectively. A spring 72 or other resilient means is retained within each rearmost chamber 66 and extends through opening 70 with one end of each spring in contact with the bottom 36 of each recess 28.

On the side walls 56 near the rear wall 58 of each retarding structure 50 are located opposing transverse aligned smooth bores 74 extending through the side walls 56 and in alignment with threaded bore 40 and smooth bore 42 located on opposing side walls 32 of each primary recess 28 when each retarding structure is fixedly mounted in each primary recess.

For a detailed description of the assembly of the payload 16 and canister sectons 14 according to the present invention, reference is made to FIGS. 1, 2, and 3. Rocket motor section 12 and canister section 14 are assembled in conventional fashion. Payload section 16 is next fixedly attached to the canister section 14 by joining the payload and canister section such that primary peripheral recess connecting bores 46 are aligned with each payload peripheral channel 48. With the canister section connecting bores 46 and payload section peripheral channels 48 aligned an explosive bolt 80 of conventional design is inserted into the passage formed by the aligned bores and recesses such that the bolt head 82 is located in the payload section recess and the threaded end 84 of the bolt is within the canister section recess. Attachment of a bolt nut 86 to the threaded end 84 of each bolt 80 fixedly attaches the canister 14 and payload 16 section together. The retarding structures 50 are then slideably pushed forward and down, into the primary recesses 28 until circular openings 68 within front walls 54 contact and close over each bolt nut 86 in locking engagement. Simultaneously, each spring 72 or other suitable resilient member is compressed within each canister recess 28. Upon placement of a retarding structure 50 within the recesses 28, a retaining pin 76 having a threaded end 78 is inserted through bore 42 and smooth bores 74 until the threaded end of the retaining pin is received within the threaded bore 40. By this arrangement the retarding structures 50 are pivotally retained at their aft ends and are temporarily interlocked at their fore ends within each recess 28 associated therewith. In this fashion the retarding structures 50 provide a smoothly fitting cover over each canister recess 28.

Each payload recess is further provided with a cover plate (not shown) and explosive bolt functioning or actuating means 88 including electric leads 90 communicating with signaling and triggering means for applying a potential to detonate the explosive bolts 80 and separate the payload 16 and canister 14 sections.

After missile 10, assembled according to the disclosed invention has been launched and attains a predetermined altitude it becomes necessary to separate and recover the payload section 16 from the other missile components. Programmed instrumentation contained with the payload section 16 actuates or causes an electrical discharge to function the explosive bolts 80. Simultaneous detonation of the bolts 80 sever the bolts allowing separation of the payload section 16 from the canister section 14. The force of the exploding bolts 80 forces the bolt nuts 86 rearwardly to impact upon bulkhead 62 within each retarding structure 50. The force of the bolt nuts 86 impacting on the bulkhead wall 62 imparts an upward and rearward movement to the retarding structures 50. This allows the arcuate surface 52 to interact with the slipstream passing over the missile surface. As this occurs the retarding structures 50 are deployed to about a 45 degree angle effecting a braking action thereby enhancing separation of the payload section 16 from the canister section 14. The coiled resilient spring 72 uncoils at the same time the retarding structure 50 is deploying as backup to insure that the retarding structures deploy. The system design is such however that the retarding means will function without spring assistance. As the canister section 14 is separating from the payload section 16, the parachute 20 retained within the canister cavity 18 deploys to provide controlled descent of the payload section for subsequent recovery.

The preferred embodiment disclosed above positions the explosive bolts such that the bolt heads are located in the payload section, the bolt nut ends are in the primary recesses of the canister section and the actuating means are retained within the payload section.

It is understood however that another embodiment would reverse the bolts such that the bolt heads are located in the canister section primary recesses, the bolt nut ends are in the payload section and the actuating means housed in the canister section. Actuation of the explosive bolts in this configuration would cause the bolt heads to strike the bulkheads of each retarding structure effecting deployment of the retarding means.

The foregoing descriptions in conjunction with the appended claims constitute a disclosure such as to enable the invention to be made and used by those skilled in the missile arts. Further, the structures herein described meet the objectives of the invention and constitute an advance in the art unobvious to persons not having the benefit of the teachings contained herein.

Obviously, many modifications and variations of the present invention are possible in light of the above teachings and it is therefore to be understood that within the scope of the disclosed inventive concept, the invention may be practiced other than as specifically described.

What is claimed is:

1. A missile adapted for controllable sectional separation in a flight path comprising:

a rocket motor section;

a canister section rigidly attached to said rocket motor section and defining a central cavity open on one end;

a payload section detachably attached to said canister section and closing said open end of said central cavity;

said payload section defining at least two peripheral recesses abutting said canister sections and peripherally spaced from each other, and at least two recess channels communicating with said canister section and said payload section recesses;

said canister section defining at least two longitudinally aligned generally rectangular primary peripheral recesses peripherally spaced from each other and in alignment with said peripheral recesses on said payload section, said canister section also defining two longitudinally aligned peripheral secondary recesses aligned in parallel relationship with said primary recesses and in communication therewith, said canister section further defining bores communicating between each canister section primary peripheral recess and the corresponding payload section peripheral recess;

a minimum of two explosive bolts each passing between corresponding peripheral recesses through said bore for detachably retaining said canister section to said payload section;

means for functioning said explosive bolts in response to a signal for effecting separation of said payload section from said canister section;

retarding means pivotally retained within each of said canister section peripheral recesses and interacting with said explosive bolts for deploying said retarding means and retarding flight of said canister after functioning of said explosive bolts;

resilient means for urging deployment of said retarding means disposed between said retarding means and said canister section peripheral recess; and a parachute disposed within said central cavity of said canister section and attached to said payload section.

2. A missile according to claim 1 wherein said resilient means is a spring.

3. A missile adapted for controllable sectional separation in a flight path comprising:

a rocket motor section;

a canister section rigidly attached to said rocket motor section and defining a central cavity open on one end;

a payload section detachably attached to said canister section and closing said open end of said central cavity;

said payload section defining at least two peripheral recesses abutting said canister section and peripherally spaced from each other and at least two recess channels, said peripheral recess channels communicating with said canister section recesses;

said canister section including a canister section exterior surface further defining at least two generally rectangular primary longitudinally aligned peripheral recesses defined by front, side, bottom and rear walls, said recesses peripherally spaced from each other and in alignment with said peripheral recesses on said payload section, said recesses having adjacent secondary recesses longitudinally aligned with said peripheral recesses and communicating therewith;

a pair of opposing coaxially aligned retaining bores located on said side walls of said canister section peripheral recesses positioned proximate said rear walls of said recesses, one bore having a threaded inner surface and the opposing bore having a smooth inner surface communicating with the exterior surface of said canister section;

said canister section further defining at least two longitudinally aligned connecting bores communicating between each canister section primary peripheral recess and each corresponding payload section peripheral channel and recess; a minimum of two explosive bolts each having a bolt head and a threaded nut end, said bolts passing through said connecting bores for detachably retaining said canister section to said payload section;

means for functioning said explosive bolts in response to a signal for effecting separation of said payload section from said canister section; retarding means pivotally retained within each of said canister section peripheral recesses including resilient means for urging deployment of said retarding means disposed between said retarding means and said recesses; said retarding means interacting with said explosive bolts for deploying said retarding means and retarding flight of said canister section after functioning of said explosive bolts, said retarding means comprising at least two rectangular shaped retarding structures axially aligned and retained in said canister section peripheral recesses, said structures each having an arcuate shaped surface, front, side, rear and bottom walls, a bulkhead wall vertically disposed between said front and rear walls defining front and rear chambers therein, said bottom wall having a circular opening between said bulkhead and said rear wall and communicating with said rear chamber for receiving and retaining said resilient means;

a pair of opposing transverse aligned smooth bores extending through said structure side walls proximate said rear wall and aligned with said retaining bores of said canister section when said retarding means are in a stores position within said canister peripheral recesses;

retaining pins having threaded ends, each pin received through said smooth transverse bore on said missile exterior surface, each pin extending through said smooth bores in each retarding structure and seating said threaded end in said opposing threaded bore on said side wall of each peripheral recess thereby retaining each retarding structure within said primary recesses;

a parachute disposed within said central cavity of said canister section and attached to said payload section;

means for fixedly attaching said parachute to said payload section; and means for deployment of said parachute upon separation of said canister section and said payload section.

4. A missile according to claim 3 wherein said retarding structures are positioned within said primary peripheral recesses, said circular openings in said front walls of said retarding means structures are in mated relationship with said explosive bolt threaded nut end and each retarding means arcuate structure surfaces are retained in abutting relationship with said secondary recesses forming a cover over said recesses.

5. A missile according to claim 3 wherein said means for functioning said explosive bolts consists of electrical leads capable of applying a potential to detonate said bolts thereby separating said canister section and said payload section.

6. A missile according to claim 3 wherein said explosive bolts are retained within said connecting bores communicating with each canister section primary peripheral recess and each payload section peripheral recess such that each explosive bolt nut end is positioned in each circular opening in each front wall of said retarding structures, each bolt head end is positioned within each payload recess, said functioning means detonating said explosive bolts, each bolt nut end severing from said bolts and striking each bulkhead of each retarding structure, said resilient means and said bolt nut ends effecting deployment of said retarding structures angularly at about a 45 degree angle to said canister section surface.

7. A missile according to claim 3 wherein said explosive bolts are retained within said connecting bores communicating with each canister section primary peripheral recess and each payload section peripheral recess such that each explosive bolt including a bolt head and a bolt nut end is positioned such that said bolt head is retained in each circular opening in each front wall of said retarding structures, each bolt nut end is positioned within each payload recess, said functioning means detonating said explosive bolts, each bolt head severing from said bolts and striking each bulkhead of each retarding structure, said resilient means and said bolt heads effecting deployment of said retarding structures angularly at about a 45 degree angle to said canister section surface.

8. A missile according to claim 3 wherein said resilient means is a spring.

* * * * *